US005803279A

United States Patent [19]

Stallbaumer et al.

[11] Patent Number: 5,803,279

[45] Date of Patent: Sep. 8, 1998

[54] AUTOMATICALLY DEPLOYABLE LOAD-LINE RECEIVING MAST STRUCTURE FOR LIMITING DEFLECTION OF PROPORTIONALLY EXTENDABLE BOOM SECTION CRANE

[75] Inventors: Richard J. Stallbaumer, Overland Park, Kans.; James A. Rusk, Jr., Kansas City, Mo.; Raymond F. Pitman, Leawood, Kans.

[73] Assignee: Pioneer Engineering, Grandview, Mo.

[21] Appl. No.: 713,743

[22] Filed: Sep. 13, 1996

[51] Int. Cl.[6] ..... B66C 23/04

[52] U.S. Cl. ..... 212/299; 212/230; 212/231

[58] Field of Search ..... 212/294, 298, 212/299, 230, 231, 295, 300

[56] References Cited

U.S. PATENT DOCUMENTS

| | | | |
|---|---|---|---|
| 3,944,082 | 3/1976 | Fritsch | 212/300 |
| 4,178,591 | 12/1979 | Geppert | 212/278 |
| 4,394,914 | 7/1983 | Privat | 212/3 |
| 4,523,669 | 6/1985 | Smith | 212/231 |
| 4,596,336 | 6/1986 | Zwagerman | 212/296 |
| 5,597,078 | 1/1997 | Becker et al. | 212/231 |

*Primary Examiner*—Thomas J. Brahan

*Attorney, Agent, or Firm*—Hovey, Williams, Timmons & Collins

[57] ABSTRACT

A proportionally extendable multi section boom crane is provided with an automatically erectable mast pivotally carried by one of the boom sections. The mast, which has a secondary sheave on the outer end thereof, normally rests in a stowed position adjacent the boom section on which it is mounted. The load line of the crane extending from the winch at the base of the boom section is trained over the secondary sheave, as well as sheave structure on the outermost end of the outer boom section. Elongated rod structure carried by one of the extendable boom sections outwardly of the crane has coupling means thereon engageable with the mast to initiate erection thereof after the proportionally movable boom sections have been extended a predetermined extent, normally after about 50% extension thereof. Passage of the load line over the mast in an erected position causes bending forces imposed on the extended boom by a weight suspended from the outermost end of the load line produces forces in opposition to the bending moment on the boom sufficient to prevent significant deleterious deflection of the boom from the longitudinal axis thereof.

21 Claims, 5 Drawing Sheets

AUTOMATICALLY DEPLOYABLE LOAD-LINE RECEIVING MAST STRUCTURE FOR LIMITING DEFLECTION OF PROPORTIONALLY EXTENDABLE BOOM SECTION CRANE

FIELD OF THE INVENTION

This invention relates to a crane having proportionally extendable boom sections and wherein load-line receiving mast structure is provided that is automatically deployed to limit undesirable deflection of the boom under a load when the sections are extended to an extent that the overlap thereof is no longer capable of limiting such deflection.

Cranes having proportionally extendable boom sections have gained increasing acceptance because the extent of relative overlap of all of the boom sections remains proportional during boom extension, thus retaining substantially uniform distribution of the boom weight along the length of the boom as it extends. In sequential multiple boom section cranes the innermost boom extends to its full length before extension of the next boom section is initiated. Therefore, the boom sections of less cross-sectional area are each required to bear the full load when fully extended, thereby reducing the capacity of the crane as a compared with a same-size proportionally extendable boom section crane.

However, once the extent of boom overlap of a proportionally extendable boom section crane decreases below about 50%, the overlap thereof is insufficient to preclude boom deflection under heavy loads. The boom operator therefore is required to decrease the load with each pickup as the length of the proportionally extendable boom is increased beyond about a 50% overlap. In many instances this is a significant limitation on the overall utility of the crane.

Accordingly, there has been a need for a proportionally extendable boom section crane which is resistant to boom deflection at the longer boom extension lengths thereof, thereby permitting the crane operator to raise loads to higher and higher elevations without significantly decreasing the weight of the load that can be lifted during each lift cycle.

DESCRIPTION OF THE PRIOR ART

Proportionally extendable boom section cranes have been in use for some time and have gained increasing industry acceptance because the extent of overlap of the boom sections during extension of the boom remains proportional thus limiting boom deflection through a significant portion of boom extension. Only after the extent of boom overlap between adjacent boom sections exceeds about 50% does boom deflection become a significant adverse factor. The problem is exacerbated as the number of extendable boom sections increases. Four and five boom section cranes are now widely available for a multiplicity of different uses. The greater the number of crane boom sections, the higher that loads may be lifted from ground level. However, this higher elevation capacity generally comes at the expense of a significant limitation on the weight of a load that may be lifted at any one time.

Large capacity construction cranes made up of a series of cross-girder framework units have been in use for many years because the reach of the crane can be readily increased by simply bolting more frame units on the end of the boom. However, as the length of the constructed boom is increased, the load that may be raised with each lift must be decreased accordingly. It has been known for some time that the lifting capacity of these large construction cranes can be increased by attaching a series of cables to the outer end of the boom and connecting the cables to a support gantry projecting perpendicularly from the base of the boom, thus creating a triangular arrangement made up of the boom framework, the connecting cables, and the gantry structure. The load line in certain cranes has extended either directly from the winch at the base of the construction crane over sheaves at the outer end of the boom, or has been trained over a secondary sheave at the outer end of the gantry support structure. The boom support line also served as the means for raising and lowering the boom. Variation of the overall length of the crane required the cross-girder framework to be lowered to the ground and framework sections inserted or removed. This was a significant limitation on the usefulness of the crane and obviously constituted a time-consuming and expensive operation.

At least one foreign crane manufacturer has introduced a heavy duty proportionally extendable booms section crane utilizing erectable mast structure under complex computer control for limiting boom deflection under heavy loads. In these cranes, the mast is mounted on the outer end of the base boom section and is erected to a position perpendicular to the boom when the computer controls sense that boom sections have been extended to a length such that boom deflection limitation is required. In these cranes, a complex double-stretch cable arrangement is provided for opposing deflection loads on the boom. A mast control winch is mounted on the innermost end of the mast. A cable trained over the drum of that control winch extends along the length of the mast, thence over a sheave on the outer end of the mast, extends upwardly therefrom and is trained over a sheave block suspended from the outermost end of the third stage of at least one version of the crane having a four stage boom, returns to the sheave on the mast, next extends downwardly to a sheave block on the bottom of the base boom, extends upwardly therefrom and is trained over the sheave on the mast, and then returns to the mast winch. The need for this complicated cable structure is to accommodate extension and retraction of the boom sections while the mast remains in its upright position. A load line extends from a main winch at the bottom of the base boom over another sheave on the outer end of the mast and then over the sheave block at the outermost end of the fourth stage boom.

Because of the requirement that the mast cable be payed out or taken in as the boom sections are extended and retracted, and in order to compensate for the differing loads that are picked up by the crane at different overall boom lengths and angles, the manufacturer found it necessary to incorporate a microprocessor control unit as a part of the crane for controlling operation of the mast winch. This is not only expensive construction to fabricate and maintain, but also necessitates a failsafe backup in the event of microprocessor failure while a load is being lifted by the crane. The microprocessor also must automatically operate the mast winch as required to increase or decrease the tension in the mast control cables as a function of the load being lifted by the crane.

It has also been suggested to provide a sequential boom section crane with an hydraulic cylinder erectable mast wherein a boom support cable is connected to a control winch at the base of the boom, extends over a sheave on the erectable mast, and thence over a sheave block connected to the outermost end of the outermost boom section before returning for connection to the outermost end of the mast. Here again, complicated control mechanism is required for changing the length of the mast control cable as the boom sections are extended and retracted, and to compensate for varying loads picked up by the crane boom. The deflection problem is exacerbated in this instance though by virtue of the fact that the boom sections are extended sequentially and not proportionally.

These prior art cranes having erectable masts require that the mast be mounted on the base boom, either because of the mounting of the cable-control winch on the mast itself, thus requiring hydraulic fluid connections thereto, or as a result of the utilization of hydraulic cylinders for raising and lowering the mast, which again requires hydraulic fluid be supplied thereto.

SUMMARY OF THE INVENTION

A crane having an extendable boom relies upon the cantilever support for the boom at one end thereof to carry the load imposed upon the outer end of the boom. As the boom is lengthened, an increasingly greater force is applied to the outer end of the boom thus imposing greater and greater bending loads on the cantilever beam. The result is more and more deflection of the outer extent of the boom away from the longitudinal axis thereof. Deflection of the boom is undesirable for a number of reasons. Unacceptable bending forces placed on the structure can permanently deform the individual boom sections, materially alter the structurally interconnection therebetween, and in some instances even cause catastrophic failure of the boom assembly. Boom deflection also makes it difficult for the crane operator to precisely position loads which are being lifted by the crane.

In order to overcome these problems, among others, this invention concerns a proportional boom section crane of the type having a base assembly provided with a rotatable turret and a base boom section pivotally carried by the turret along with a series of proportionally extendable boom sections supported by the base boom section. A winch unit is mounted on the base assembly and provided with a drum for receiving the load line that extends along the length of the boom and is trained over sheave structure on the outermost boom section for lifting of a load. An erectable mast pivotally carried by one of the boom sections normally lays along the top of the boom section on which the mast is mounted. The mast is swingable to an erect position extending outwardly at an angle from the boom section toward the load line. A secondary sheave provided on the outer end of the mast is positioned so that the load line extends thereover between the winch drum and the outermost primary sheave structure. Means is provided on the boom sections which is engageable with the mast for automatically deploying the mast and swinging the latter toward the erected position thereof in response to predetermined proportional extension of the boom section. The mast and secondary sheave thereon are located such that upon initiation of erection of the mast, the load line extending from the winch drum over the secondary sheave to the primary sheave structure in conjunction with the longitudinal axis of the boom sections defines triangulation geometry. Thus, the load line serves to lift the load and also as a result of the triangulation geometry provides required offsetting boom deflection forces upon initiation of erection of the mast which are a direct function of the overall length and angle of the boom during extension and retraction, and of the specific load that is being raised by the crane during each lift.

Desirably, the means for automatically deploying the mast is effective to initiate erection thereof after the degree of relative overlap of the boom sections falls below about 50%. In this manner, deflection of the outer end of the extended boom is minimized, even under loads that would otherwise produce impart an undesirable in-plane force and thereby deflection of the boom.

Mechanism for automatically erecting the mast in response to proportional extension of the crane boom sections may take the form of rod structure pivotally connected to one of the extendable boom sections and that has coupling means thereon engageable with connector means on the outer end of the mast so that as the boom sections are extended to a predetermined extent, the coupling means engages the connector means to effect pivoting of the mast in response to further extension of the boom sections. As a result of strategic location of the pivot points for the mast and the rod structure, as well as the point on the mast where the rod connector means is located, the mast is swung through greater degrees of arcuate travel during initial erection, as compared with arcuate movement during final erection thereof. Arcuate swinging movement of the mast from the stowed position to the final erected location generally follows a cosine function.

It is common practice for a crane operator to lift a load from the ground adjacent the truck with the boom fully retracted and extending outwardly over the load. As soon as the load has been lifted, the operator typically initiates extension of the boom sections as the turret is rotated to direct the boom toward the area in which the load is to be deposited. During this extension of the boom sections, the operator may also pay out the load line as may be required to coordinate the elevation of the load with the boom extension. In those instances where the boom requires extension to its full length, the boom sections become more and more limber as the fully extended length is approached.

The decreasing cosine function angular movement of the deployable mast in response to linear proportional boom extension is important because as the length of the overall boom assembly approaches 100% extension, instantaneous forces imposed on the boom during common interruptions of extension and retraction of the boom sections by the crane operator, are magnified at the outer reaches of the boom. This is attributable to the fact that as the boom is constantly being lengthened and shortened by the crane operator during normal operation thereof, the length of the load line extending between the winch drum and the primary sheave structure on the outermost boom section, and which also passes over the secondary sheave on the mast undergoing erection, is increased and decreased accordingly. For example, if the boom sections are 90% extended at the time that the operator interrupts further extension and either swings the turret, or otherwise raises or lowers the load as he deems appropriate, upon initiation of further extension of the boom sections, a force is imposed on the outer end of the boom accordingly to the formula F=ma. It can be seen from this formula that "a" is a significant factor in the in-plane forces that are applied to the boom as it is being extended. In view of the fact that the mast is continuing to be erected as the boom is extended from its exemplary 90% extension, and assuming that the load line is not being taken up or payed out at that point in time, the effect of further erection of the boom is to shorten the load line and cause the load to be elevated. The less the line is lengthened by this erection of the mast during further boom extension, the less the effect of "a" on the instantaneous in-plane forces applied to the boom.

Accordingly, arcuate swinging of the mast during erection that is essentially a cosine function, minimizes shortening of the load line during that part of boom extension, i.e., the last 10% or so, where the boom is most susceptible to deflection loads. The most rapid elevation of the mast occurs during its initial erection while the boom is more rigid because of boom section overlap.

DETAILED DESCRIPTION OF THE PREFERRED EMBODIMENTS

Figure 1:
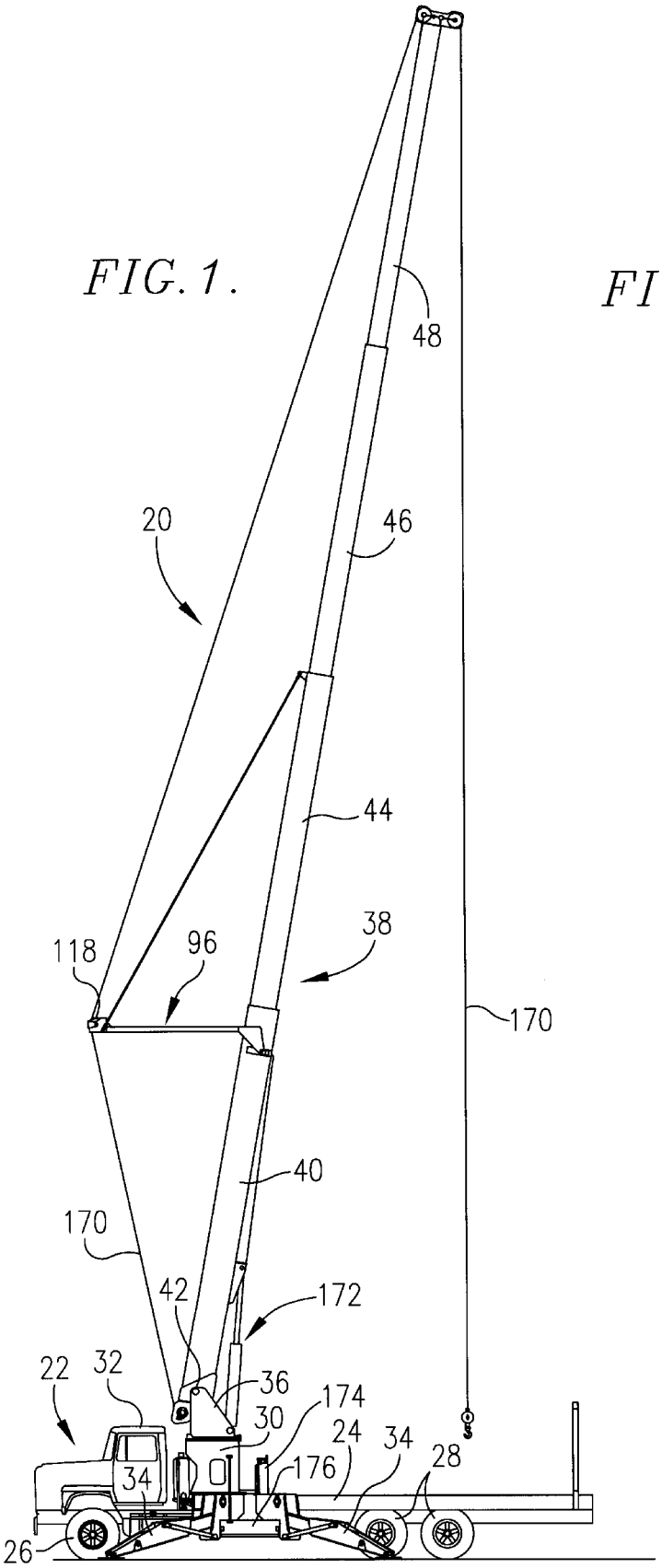
FIG. 1 is a side elevational view of a proportional multiple boom section crane having automatically deployable mast structure for limiting deflection of the boom after it has been extended to a predetermined extent.

A mobile proportional multiple boom section crane in accordance with a preferred embodiment of the invention is illustrated in FIG. 1 of the drawings and broadly designated by the numeral 20. Crane 20 is of typical design and therefore is mounted on a conventional truck 22 having a reinforced chassis 24 carried by front wheels 26 and a series of rear wheels 28. The main frame 30 of crane 20 is affixed to the frame of chassis 24 and for stability purposes is normally located directly behind truck cab 32 but may if desired be mounted directly over the wheels 28, or even at the rear end of the chassis 24. Selectively deployable outrigger structure 34 is desirably provided to stabilize the crane 20 during use. As depicted, the outrigger structure 34 may be of the type wherein the legs define an "X" pattern upon deployment.

A turret 36 is rotatably supported on the upper end of main frame 30 for 360° rotation in either direction about a vertical axis. The proportionally extendable, multiple section boom broadly denominated 38 of crane 20 includes a main first stage boom section 40 pivotally carried by turret 36 for swinging movement about horizontal shaft 42. As shown in FIG. 1, boom 38 includes three extendable second, third and fourth stage boom sections 44, 46 and 48 respectively, with each being successively telescoped within each other and all being telescopically received within fixed boom section 40.

Figure 10:
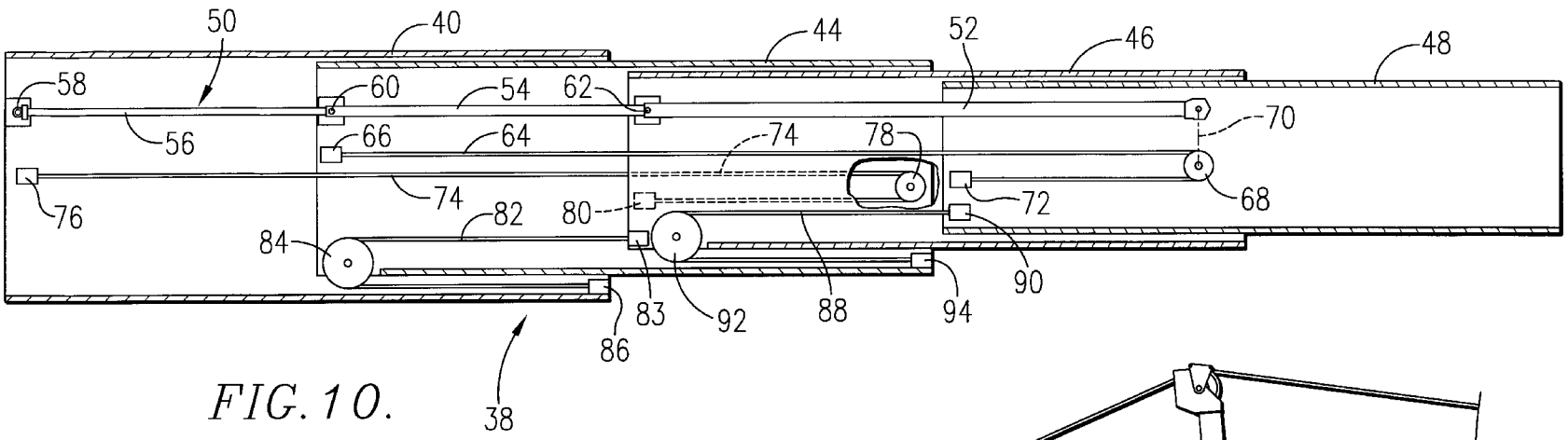
FIG. 10 is an enlarged schematic representation of mechanism for proportionally extending and retracting the multiple moveable boom sections of the crane boom.

Viewing FIG. 10 of the drawings, it is to be seen from the schematic representation of that figure, that one form of mechanism for proportionally extending and retracting boom sections 44, 46 and 48 respectively, may comprise a two-stage, double-acting piston and cylinder assembly broadly designated 50. Assembly 50 typically includes a main outer cylinder 52 which reciprocally receives a secondary cylinder 54 that also serves as a rod, and an inner rod 56 telescopically received by secondary cylinder 54. As is apparent from FIG. 10, the outermost end of rod 56 is affixed at the point 58 to the innermost base end of main boom section 40, the end of cylinder 54 which receives rod 56 is affixed at the point 60 on the innermost end of second stage boom section 44, and the innermost end of cylinder 52 is affixed at the point 62 to the innermost end of third stage boom section 46. The outermost end of cylinder 52 extends into the innermost end of fourth stage boom section 48, but is not affixed to that boom section.

A flexible cable 64 is secured to the innermost end of second stage boom section 44 at point 66, is trained around a pulley 68 that is mounted on a shaft 70 carried by the outermost end of cylinder 52, and is connected to the innermost end of fourth stage boom section 48 at point 72. Another flexible cable 74 is secured to the innermost end of first stage boom section 40 at point 76, is trained around a pulley 78 secured to the outermost end of second stage boom section 44 between that boom section and third stage boom section 46, and is secured to the innermost end of third stage boom section 46 at point 80.

A third flexible cable 82 is secured to the innermost end of third stage boom section 46 at point 83, is trained around pulley 84 on the innermost end of second stage boom section 44, and is connected to the outermost end of first stage boom section 40 at point 86. A fourth flexible cable 88 is secured to the innermost end of fourth stage boom section 48 at point 90, is trained around a pulley 92 on the innermost end of third stage boom section 46, and is connected to the outermost end of second stage boom section 44 at point 94.

Figure 3:
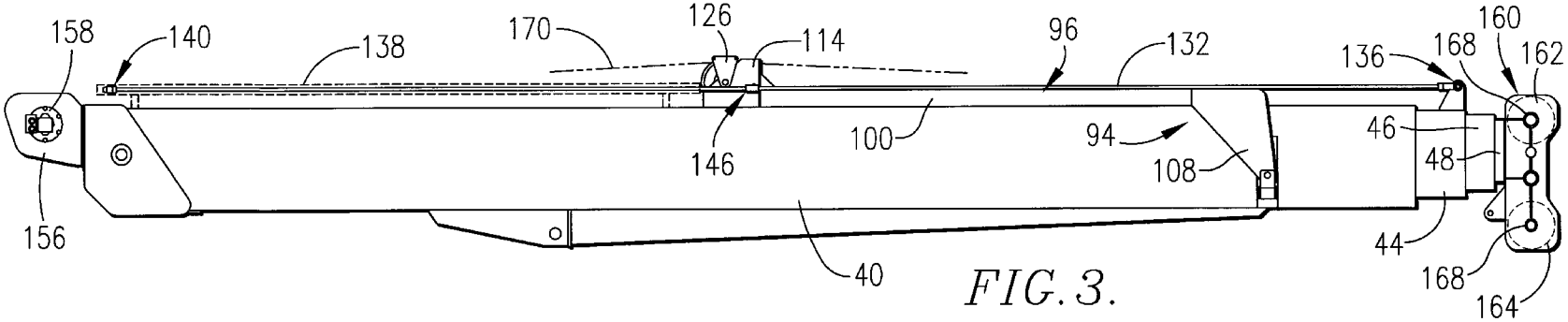
FIG. 3 is an enlarged side elevational view in fully retracted condition of the proportional multiple section boom of the crane as shown in FIG. 1, with certain parts being shown in dotted and dash-dot lines for clarity.
Figure 4:
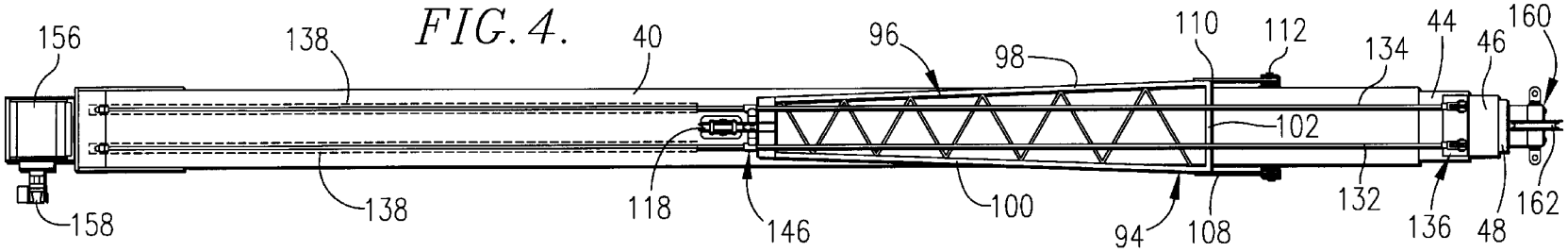
FIG. 4 is a plan view of the boom structure as depicted in FIG. 3.
Figure 5:
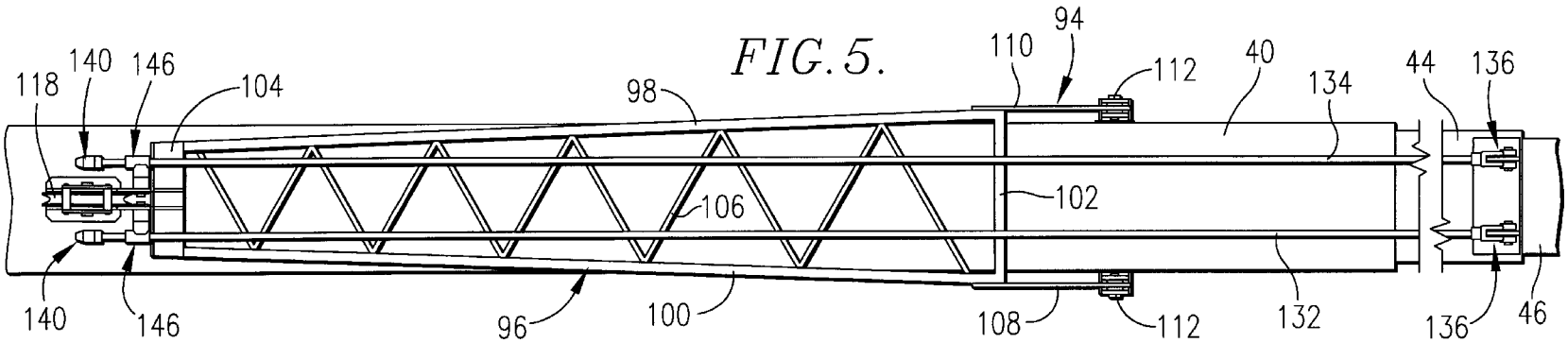
FIG. 5 is an enlarged fragmentary plan view of a part of the boom structure as shown in FIG. 4.

Viewing FIGS. 3–8, it is to be seen that automatically deployable mast structure broadly designated 94 includes a mast 96 normally overlying the uppermost surface of first stage boom section 40. Mast 96 may be constructed of framework made up of a pair of elongated main members 98 and 100 which are joined by an inner cross member 102 and an outer cross member 104. A series of triangulation-forming cross struts 106 may be provided to furnish support for main members 98 and 100. Generally triangular plates 108 and 110 pivotally mounted on opposite sides of first stage boom section 40 in proximal relationship to the outer end thereof are affixed to the innermost extremities of main mast members 98 and 100. It is to be seen from FIGS. 3 and 7 that the plates 108 and 100 are pivotally carried by opposed side walls of first stage boom section 40 through the medium of pivot pins 112 that are axially aligned transversely of first stage boom section 40. The main member 98 of mast 96 are affixed to respective plates 108 and 110 in disposition such that main members 96 may lie flat against the upper surface of first stage boom section 40 as shown in FIG. 3.

The cross member 104 at the outermost end of mast 96 supports two spaced, parallel support plates 114 and 116 which serve to mount a secondary sheave 118 for rotation about a pivot shaft 120 whose axis is parallel with the axes of pivot pins 112. A pair of outwardly directed flanges 122 and 124 projecting outwardly from the lower margins of plates 114 and 116 respectively, are configured to lie flatly against the upper surface of first stage boom section 40.

A pair of triangular plates 126 and 128 secured to plates 114 and 116 respectively, and projecting upwardly therefrom, serve to mount two rollers 129 and 130 which overlie sheave 118 for reasons to be explained.

Figure 6:
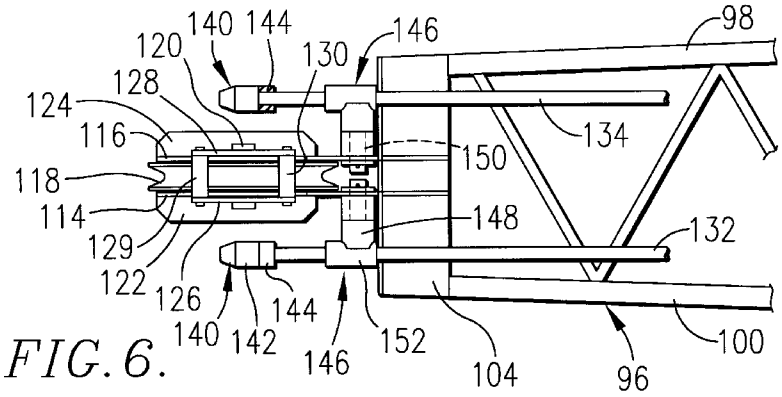
FIG. 6 is an enlarged fragmentary view of the outer end of the deployable mast structure of the invention in its stowed position, along with the associated connector rod structure for effecting erection of the mast in response to proportional extension of the boom sections.
Figure 8:
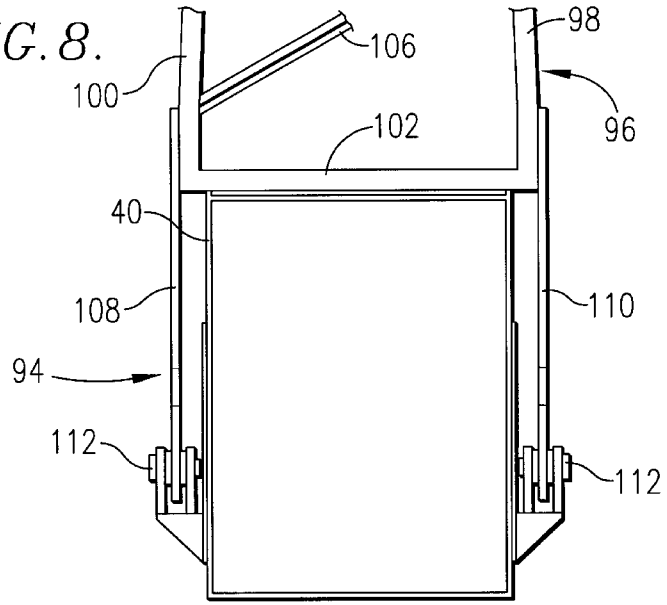
FIG. 8 is an enlarged fragmentary plan view of a part of the erected mast and associated boom section as shown in FIG. 7.

A pair of elongated connector rods 132 and 134 are secured to the outermost end of second stage boom section 44 in overlying relationship to the upper surface thereof, and project rearwardly therefrom over the top of first stage boom section 40. The outermost ends of rods 132 and 134 are pivotally connected to second stage boom section 44 by mounting bracket and clevis structure broadly designated 136. As is best shown in FIGS. 3–6, the rods 132 and 134 extend rearwardly from the outermost end of second stage boom section 44 in overlying relationship to mast 96 when the latter is in the stowed position thereof. Elongated tubes 138 carried by the upper surface of first stage boom section 40 receive and support the outer free ends of rods 132 and 134. Couplers 140 are secured to the outer end of each rod 132 and 134 and as shown in FIG. 6 each take the form of an enlarged head 142 along with an associated tubular elastomeric grommet 144 surrounding respective rods 132 and 134.

The plates 114 and 116 also serve to mount outwardly projecting gimbal structures 146 each comprising a gimbal component 148 rotably carried on a respective shaft 150 extending outwardly from a respective plate 114, 116, as well as a sleeve component 152 which slidably receives a corresponding rod 132 and 134.

Winch 154, shown as being mounted on the innermost end of first stage boom section 40 but also being mountable on turret 36 if desired, has a winch drum 156 rotatable about a horizontal axis. Drum 156 is rotated in a desired direction by a reversible hydraulic motor 158.

Primary sheave structure broadly designated 160 is mounted on the outermost end of fourth stage boom section 48. Typically, primary sheave structure 160 includes a pair of sheaves 162 and 164 rotatable on spaced, parallel horizontal axes 166 and 168 respectively.

A load line 170 trained around drum 156 of winch 146 extends over secondary sheave 118 beneath rollers 129 and 130, and thence over sheaves 162 and 164.

It is to be pointed out with respect to the schematic representation of the multiple section boom 38, as depicted in FIG. 10 that the piston and cylinder assembly 50 operates to proportionally extend and retract cylinders 52 and 54 with respect to rod 56. During extension of the boom sections for example and consequent simultaneous proportional outward shifting of cylinders 54 and 52, the fourth stage boom section 48 is extended by the flexible cable 64 connected to fourth stage boom section 48 and trained over roller 68 mounted on the outermost end of cylinder 52. At the same time, third stage boom section 46 is shifted outwardly as a result of flexible cable 74 connected to third stage boom section 46 and trained over roller 78 secured to second stage boom section 44. Finally, second stage boom section 44 moves outwardly proportionally to extension of the other movable boom sections because of flexible cable 82 which is connected to first stage boom section 40 and to the third stage boom section 4 and is trained over pulley 84 secured to the second stage boom section 44. Proportional retraction of the boom sections 44–48 takes place in the same manner by reverse simultaneous operation of the cable and double-acting cylinder mechanism as described.

Means for pivoting first stage boom section 40 about shaft 42 desirably takes the form of a hydraulic piston and cylinder assembly 172. Control of deployment of outrigger structure 34, rotation of turret 36, elevation and lowering of first stage boom section 40 by piston and cylinder assembly 172, extension and retraction of second, third and fourth stage boom sections 44, 46 and 48 by operation of piston and cylinder assembly 50, and rotation of drum 156 of winch 146, desirably is available by manipulation of suitable hydraulic valves which are located no pedestal 174 at operator station 176 on each side of truck chassis 24.

Figure 7:
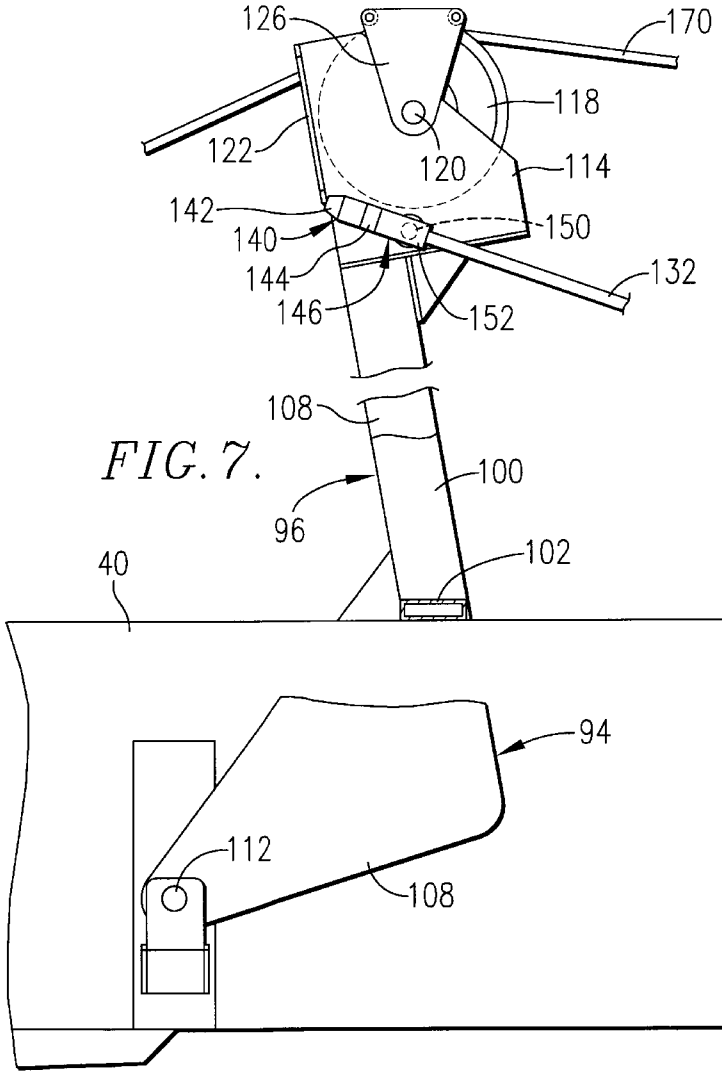
FIG. 7 is an enlarged fragmentary side elevational view of the deployable mast structure as shown in FIG. 6 but illustrating the mast structure in its fully erected position.

The rods 132 and 134 are of a strategic length, and the couplers 140 thereon are positioned such that the couplers engage respective gimbal structures 146 on mast 96 after second stage boom section 44 has been extended to a predetermined extent with respect to the first stage boom section 40. In this respect, it is to be understood that the third and fourth stage boom sections 46 and 48 will likewise be proportionally extended by the structure shown diagrammatically in FIG. 10. Preferably, rods 132 and 134 are of a length causing the couplers 140 thereon to first engage respective gimbal structures 146 at a point where the second stage boom section 44 has been extended approximately 50% of the total extension length thereof. The rods 132 and 134 are also of a length and the point of connection thereof to second stage boom section 44 is such that the mast 96 is raised to its fully erected position as shown in FIGS. 1 and 7 when the boom sections 46–48 have reached the outermost ends of their paths of travel and therefore are fully extended.

Figure 9:
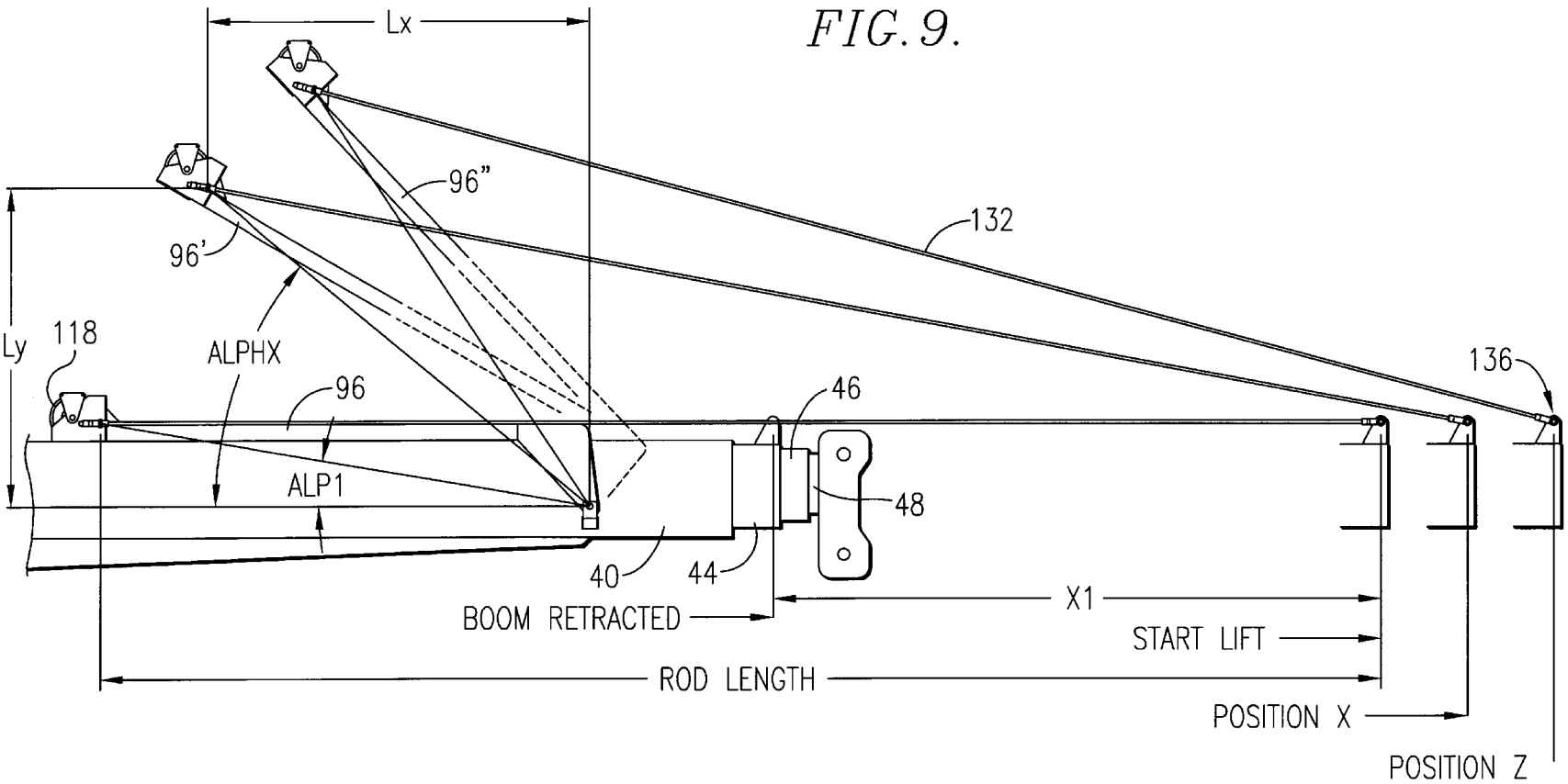
FIG. 9 is an essentially diagramatic, fragmentary representation of the proportionally extendable multiple section boom embodying the deployable mast structure of this invention and illustrating the degree of decreasing angular swinging of the mast structure in response to linear proportional lengthening of the boom by extension of the movable boom sections.

Viewing FIG. 9, the effective length of rods 132 and 134, i.e., the distance between the innermost edges of grommets 144 to the pivot axes of mounting and clevis structures 136 is indicated by the designation "ROD LENGTH". The retracted position of second stage boom section 44 is identified as "BOOM RETRACTED" whereas the point at which couplers 140 engage respective gimbal structures 146 during extension of the second stage boom section 44 is identified on FIG. 9 as "START LIFT". Thus, the distance identified as "X1" represents the extent of the path of travel of the second stage boom section 44 before the couplers 140 of rods 132 and 134 are brought into contacting engagement with respective gimbal structures 146 of mast 96. "ALP 1" represents the angle between the horizontal axis of first stage boom section 40, and a line drawn between the axes of shafts 150 of gimbal structures 146, and the pivot pins 112 that swingably support mast 96 on first stage boom section 40.

When second stage boom section 44 has moved through a displacement represented by its "POSITION X", the mast 96 is erected to a position 96' representing a vertical displacement indicated by the distance "Ly" and thereby through an arc identified as "ALPHX". Erection of the mast 96 is accomplished by virtue of the pull of rods 132 and 134 on the upper end of mast structure 94 by virtue of interengagement of couplers 140 with respective gimbal structures 146 secured to plates 114 and 116. The horizontal displacement of the axes of shafts 150 supporting gimbal structures 146 during movement of mast 96 to position 96' is represented by the line "Lx".

However, when second stage boom section 44 is extended a further distance equal to the distance between the "START LIFT" and "POSITION X", to the location identified as "POSITION Z" in FIG. 9, mast 96 is elevated to the position 96'''. It is therefore apparent from FIG. 9, that by virtue of the geometric location of the pivot axis for pins 112 relative to the pivot axis of gimbal structures 146, and the positioning of the axis of connection of rods 132 and 134 to second stage boom section 44, the mast 96 is elevated through an angular velocity that constantly decreases in relationship to a corresponding constant velocity extension of the boom sections. This means that during initial erection of the mast, the erection occurs more rapidly than is the case when the mast approaches its final erected position in general accordance with a cosine function.

The actual arcuate travel of mast 96 of a preferred embodiment of this invention during erection of the mast thereof is represented schematically in FIG. 9 wherein can be seen that during a first increment of travel of second stage boom section 44, the mast is rotated through an arc of about 29.5° with respect to the horizontal. During a second increment of travel of second stage boom section 44, equal to the increment of boom section travel, the mast 96 is raised to a point wherein the longitudinal axis of the mast is at an angle of about 46.0° with respect to the horizontal. During a third increment of travel of second stage boom section 44 equal to the preceding incremental path, the mast 96 is swung through an angle equal to about 59.0° with respect to the horizontal. Upon movement of the second stage boom section 44 through a fourth increment of travel which is the same as each of the preceding increments, the mast 96 is swung through an arc to a point which is at an angle of about 70.0° with respect to the horizontal. Increment of travel of second stage boom section 44 which is of the same length as each of the preceding increments, results in mast 96 being elevated to a position wherein it is at an angle of about 80.0° with respect to the horizontal. At this position of the second stage boom section 44, the boom section is at the outermost end of its path of travel. Similarly, at this position of mast 96, the mast is at the end of its rotational path. It is preferred in this respect, although not required, that the geometry of the parts be designed to limit rotational movement of mast 96 to an angular path of less than about 90°, thus avoiding any tendency for the mast to go over center. The cross member 102 of mast 96 rests flatly against the upper surface of first stage boom section 40 (FIG. 7) when mast 96 is the last position.

It is to be observed from FIG. 1 for example that the mast 96 with secondary sheave 118 thereon is located such that upon initiation of erection of the mast 96 and continuing throughout the arcuate path of travel thereof until it reaches its final position as depicted in FIGS. 1 and 7, the load line 170 extending from winch drum 156, over secondary sheave 118 and around primary sheave structure 160 in conjunction with the longitudinal axis of boom 38 defines triangulation geometry where the load line serves to lift the load and also as a result of the triangulation geometry provides required offsetting boom deflection forces upon initial erection of the mast which are a direct function of the overall length and angle of the boom during extension and retraction and a direct function of the specific load being lifted by the boom 38.

In the operation of crane 20, the load line 170 trained around drum 156 as well as outermost primary sheaves 162 and 164, also lays across secondary sheave 118 when the mast 96 is in its stowed position, as shown in FIG. 3. The plates 126 and associated rollers 129 and 130 serve to retain the load line 176 within the groove of sheave 118 notwithstanding the fact that during pay out or take in of the load line, the length of the line unwinding from the drum or rewinding there on, moves back and forth across the horizontal width of the drum 156. In like manner, sheave 118 in cooperation with the plates 126 and rollers 129 and 130 cause the length of the load line 170 extending between sheave 118 and sheave 162 to always remain along the center line of the upper surface of the extendable boom sections even though the load line being payed out from or taken in by the drum 156 of winch 146 tracks back and forth across the width of the drum and therefore is at any one of varying angles between the drum 156 and sheave 118.

The provision of erectable mast structure 94 which receives load line 170 thereover serves to counteract the in-plane deflection forces that would otherwise be applied to the outer end of the multiple section boom 38 when the movable boom sections have been extended to a predetermined degree with respect to the first stage boom section 40. As previously noted, the lengths of connector rods 132 and 134 are chosen such that the mast 96 commences to elevate at about the point where the extendable boom sections have each been shifted outwardly approximately one-half of the full extension distance thereof. Continued extension of the proportionally extendable boom sections causes the mast to be elevated in accordance with the angular displacements represented schematically in FIG. 9. The mast 96 is raised to higher and higher elevations as the overall length of the boom 38 is extended more and more. As a result, loads imposed on the outer end of the boom suspended from the outermost length of load line 170*a* (FIG. 1) depending from sheave structure 160 tending to bend the extended boom downwardly, are opposed by forces in the opposite direction sufficient to prevent significant deflection of the boom. One feature of the invention is the fact that the triangulation geometry of the load line supported by the mast structure provides desired force compensation against boom deflection which automatically compensates for changes in the angularity of boom 38 relative to the horizontal and variations in the load at those different angles. Noteworthy is the fact that the greater the length of the boom 38 and thereby the higher the forces tending to deflect the boom 38 as result of weight suspended from length 170*a* of load line 170, the higher the mast structure 96 is elevated to provide forces in opposition to such bending moments.

Figure 2:
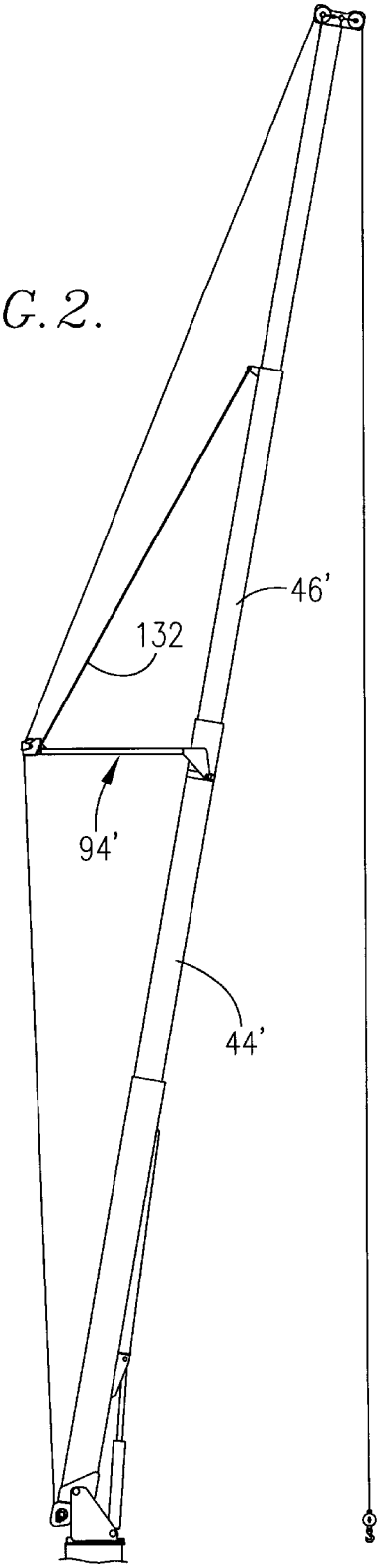
FIG. 2 is a side elevational view of a proportional multiple boom section crane illustrating an alternate embodiment of the automatically deployable mast structure.

In the first alternate embodiment of the invention as shown in FIG. 2, the structural components are the same as previously descried except that mast structure 94' is mounted on its second stage extendable boom section 44 while the connector rods 132' are secured to the third extendable boom section 46'. Operation of mast structure 94' is the same as set forth above with respect to mast structure 94.

Figure 11:
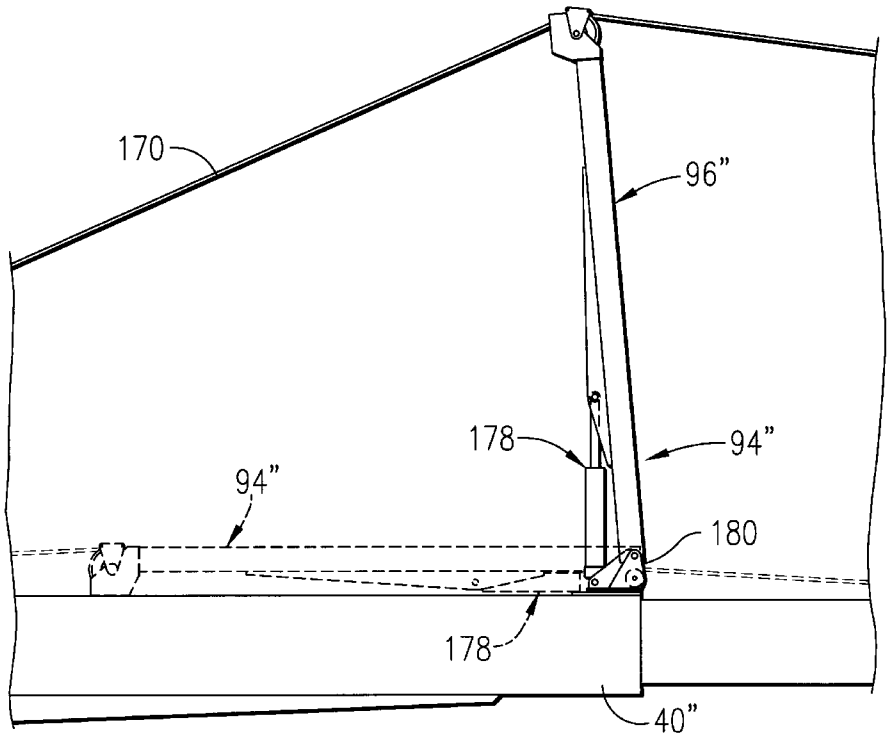
FIG. 11 is an enlarged, diagramatic representation of alternate means for raising and lowering the deployable mast structure during extension and retraction of the proportional multiple section boom of a crane.

In the second alternate embodiment of the invention as shown in FIG. 11, mast structure 94" is identical to mast structure 94 except in this instance the mast is mounted on the upper surface of first stage boom section 40" and a hydraulic piston and cylinder assembly broadly designated 178 is provided between the structure 180 for pivotally mounting mast 94" on first stage boom section 40" and the mast 96". Operation of piston and cylinder assembly 178 is hydraulically coordinated with two-stage, double-acting piston and cylinder assembly 50 to initiate erection of mast structure 94" only after the extendable boom sections have each moved through a distance equal to approximately one-half of their respective extension paths of travel.

In the case of a crane constructed in accordance with the preferred concepts of this invention as depicted for example in FIG. 1 and represented by a four-stage boom which is nominally 29 feet in length when retracted, and that is about 94 feet in length when fully extended, if a fully extended boom crane without mast structure 94 can theoretically lift 4,000 pounds at a 60° angle with respect to the horizonal under still-wind conditions, crane 20 of equal size and rated capacity should be able to lift approximately 5,500 pounds when the boom is fully extended without deleterious in-plane deflection of the boom. This represents approximately 28% increase in the effective lifting capacity of the crane at the 60° boom angle. Even more pronounced results would be obtained at increasing boom angle with respect to the horizontal. The provision of automatically deployable mast structure 94 can result in a 40% reduction in bending forces at the end of the boom at a boom angle of 70° with respect to the horizontal, thus permitting lifting of 10,500 pounds whereas a conventional crane can lift only about 6,300 pounds. At a 75° boom angle, the representative conventional crane can lift about 9,000 pounds; crane 20 of the same size and having mast structure 94 thereon should be capable of lifting in excess of 18,000 pounds.

We claim:

1. In a crane having a base assembly including a rotatable turret and a base boom section pivotally carried by the turret, a series of proportionally extendable boom sections supported by the base boom section, a winch unit on the base assembly having a winch drum, a primary sheave on the outer end of the outermost of the extendable boom sections, and a flexible load line trained around the winch drum and extending over the sheave on the outermost boom section for lifting of a load by the crane, the improvement comprising:

an erectable mast pivotally carried by one of the boom sections, said mast normally being positioned adjacent said one boom section on which it is mounted, said mast being movable to an erect position extending outwardly from said one boom section at an angle with respect to the latter in a direction toward the load line extending between the winch drum and the primary sheave, there being a secondary sheave on the mast disposed in a position for the load line to pass thereover between the winch drum and the primary sheave; and means on the boom sections and engageable with the mast for effecting erection of the mast as the boom sections are extended proportionally relative to the base boom section, said mast and secondary sheave thereon being located such that upon initiation of erection of the mast, the load line extending from the winch drum over the secondary sheave to the primary sheave structure in conjunction with the longitudinal axis of the boom sections defines triangulation geometry, said load line serving to lift the load and also as a result of said triangulation geometry providing required offsetting boom deflection forces upon initiation of erection of the mast which are a direct function of the overall length and angle of the boom during extension and retraction, and a direct function of the specific load being lifted by the crane boom sections.

2. A crane as set forth in claim 1 wherein said means on the boom section engageable with the mast for effecting erection thereof is operable to erect the mast in response to a predetermined proportional extension of the boom sections relative to the base boom section.

3. A crane as set forth in claim 2 wherein said mast erection means is operable to initiate erection of the mast only after the boom sections have been extended proportionally to a predetermined extent.

4. A crane as set forth in claim 1 wherein said means for effecting erection of the mast includes structure on one of the extendable boom sections engageable with the mast to initiate erection of the mast after the extendable boom section on which the structure is mounted has been extended to a predetermined extent relative to the remaining extendable boom sections.

5. A crane as set forth in claim 4 wherein said mast is mounted on said one boom section at the end thereof remote from said winch.

6. A crane as set forth in claim 5 wherein said structure is mounted on said extendable boom section at the end thereof remote from said winch.

7. A crane as set forth in claim 4 wherein said means for effecting erection of the mast includes connector means pivotally secured to the mast in spaced relationship from the end of the mast pivotally connected to said one boom section, said structure engaging the connector means to initiate erection of the mast after the extendable boom section on which the structure is mounted has been extended to said predetermined extent.

8. A crane as set forth in claim 7 wherein said structure includes elongated rod means pivotally secured to the boom section on which the structure is mounted, extending along the length of the boom sections, and provided with coupling means thereon engageable with said connector means after the extendable boom section on which the structure is mounted has been extended to said predetermined extent.

9. A crane as set forth in claim 8 wherein said connector means includes gimbal means on said mast, said rod means extending through said gimbal means, and said coupling means on the rod means being engageable with the gimbal means after the extendable boom section on which the structure has been extended to said predetermined extent.

10. A crane as set forth in claim 1 wherein said means for effecting erection of the mast is operable to swing the mast through an arcuate path of travel which is non-linear with respect to the proportional extension of the boom sections relative to the base boom section.

11. A crane as set forth in claim 1 wherein said means for effecting erection of the mast is operable to swing the mast through an arc wherein the degree of arcuate travel of the mast is greatest during initial erection of the mast and decreases as the mast approaches and reaches said erect position thereof.

12. A crane as set forth in claim 1 wherein said mast is at an angle of about 80° with respect to the longitudinal axis of the boom sections when the mast is in said erect position thereof.

13. A crane as set forth in claim 1 wherein is provided piston and cylinder means carried by the boom section on which the mast is mounted, and secured to the mast for effecting erection of the mast during proportional extension of the boom sections relative to the base boom section.

14. A crane as set forth in claim 1 wherein is provided means on the mast adjacent said secondary sheave for retaining the load line on the secondary sheave in all angular positions of the mast with respect to said one boom section as the load line unwinds and rewinds on the winch drum.

15. In a crane having a base assembly including a rotatable turret and a base boom section pivotally carried by the turret, a series of proportionally extendable boom sections supported by the base boom section, a winch unit on the base assembly having a winch drum, a primary sheave on the outer end of the outermost of the extendable boom sections, and a flexible load line trained around the winch drum and extending over the sheave on the outermost boom section for lifting of a load by the crane, the improvement comprising:

an erectable mast pivotally carried by one of the boom sections, said mast normally being positioned adjacent said one boom section on which it is mounted, said mast being movable to an erect position extending outwardly from said one boom section at an angle with respect to the latter in a direction toward the load line extending between the winch drum and the primary sheave, there being a secondary sheave on the mast disposed in a position for the load line to pass thereover between the winch drum and the primary sheave; and means on the boom sections and engageable with the mast for effecting erection of the mast after the boom sections have been partially extended to a predetermined extent and as the boom sections are further extended proportionally relative to the base boom section to an extent that a load to be picked up by the load line would otherwise impart an undesirable side deflection force on the extended boom, said mast and secondary sheave thereon being located such that upon initiation of erection of the mast, the load line extending from the winch drum over the secondary sheave to the primary sheave structure in conjunction with the longitudinal axis of the boom sections defines triangulation geometry, said load line serving to lift the load and also as a result of said triangulation geometry upon initiation of erection of the mast providing required offsetting boom deflection forces as a direct function of the overall length and angle of the boom during extension and retraction, and a direct function of the specific load being lifted by the crane boom sections.

16. A crane as set forth in claim 15 wherein the mast is located along the boom sections in disposition such that when the mast is in the erect position thereof, the length of the load line extending from the winch drum to the secondary sheave is at a greater angle with respect to the longitudinal axis of the boom sections than the angle of the length of the load line extending from the secondary sheave to the primary sheave with respect to the longitudinal axis of the boom sections.

17. A crane as set forth in claim 15 wherein the mast is located along the boom sections in disposition such that when the mast is in the erect position thereof, the length of the load line extending from the winch drum to the secondary sheave is approximately at the same angle with respect to the longitudinal axis of the boom sections as the angle of the length of the load line extending from the secondary sheave to the primary sheave with respect to the longitudinal axis of the boom sections.

18. A crane as set forth in claim 15 wherein said mast is mounted on the outermost end of the base boom section remote from the winch unit, said mast erection means being mounted on the extendable boom section in closest proximity to the base boom section when the boom sections are fully extended.

19. A crane as set forth in claim 15 wherein said mast is mounted on the extendable boom section in closest proximity to the base boom section when the boom sections are fully extended, and said mast erection means is mounted on the extendable boom section in next closest proximity to the base booms section when the boom sections are fully extended.

20. In a crane having a base assembly including a rotatable turret and a base boom section pivotally carried by the turret, a series of proportionally extendable boom sections supported by the base boom section, a winch unit on the base assembly having a winch drum, a primary sheave on the outer end of the outermost of the extendable boom sections, and a flexible load line trained around the winch drum and extending over the sheave on the outermost boom section for lifting of a load by the crane, the improvement comprising:

an erectable mast pivotally carried by one of the boom sections, said mast normally being positioned adjacent said one boom section on which it is mounted, said mast being movable to an erect position extending outwardly from said one boom section at an angle with respect to the latter in a direction toward the load line extending between the winch drum and the primary sheave, there being a secondary sheave on the mast disposed in a position for the load line to pass thereover between the winch drum and the primary sheave; and means on the boom sections and engageable with the mast for effecting erection of the mast after the boom sections have been partially extended to a predetermined extent and as the boom sections are further extended proportionally relative to the base boom section to an extent that the extendable boom sections no longer overlap the base boom section and one another relatively to an extent that undesirable side deflection of the boom sections would otherwise occur when a load is picked up by the load line, said mast and secondary sheave thereon being located such that upon initiation of erection of the mast, the load line extending from the winch drum over the secondary sheave to the primary sheave structure in conjunction with the longitudinal axis of the boom sections defines triangulation geometry, said load line serving to lift the load and also as a result of said triangulation geometry upon initiation of erection of the mast providing required offsetting boom deflection forces as a direct function of the overall length and angle of the boom during extension and retraction, and a direct function of the specific load being lifted by the crane boom sections.

21. A crane as set forth in claim 20 wherein said mast erection means is operable to initiate erection of the mast when the degree of overlap of the boom sections becomes less than about 50%.

* * * * *